US008353326B2

(12) United States Patent
Chang et al.

(10) Patent No.: US 8,353,326 B2
(45) **Date of Patent: *Jan. 15, 2013**

(54) THREE-DIMENSIONAL FABRIC WITH THREE-LAYERED STRUCTURE

(75) Inventors: Hoo-Sung Chang, Seoul (KR); Il-Sun Ryu, Daegu (KR)

(73) Assignees: Woongjin Chemical Co., Ltd., Gyeongsangbuk-do (KR); Youil Corporation Co., Ltd., Gyeongsangbuk-do (KR)

( * ) Notice: Subject to any disclaimer, the term of this patent is extended or adjusted under 35 U.S.C. 154(b) by 155 days.

This patent is subject to a terminal disclaimer.

(21) Appl. No.: 12/780,379

(22) Filed: May 14, 2010

(65) Prior Publication Data

US 2010/0288449 A1 Nov. 18, 2010

(30) Foreign Application Priority Data

May 18, 2009 (KR) ..... 10-2009-0043211
May 18, 2009 (KR) ..... 10-2009-0043219

(51) Int. Cl.
*E06B 9/24* (2006.01)
*D03D 15/04* (2006.01)
*D03D 9/00* (2006.01)

(52) U.S. Cl. ..... 160/84.05; 160/121.1; 160/120; 160/87; 160/168.1 R; 139/423; 139/383 R; 139/384 A

(58) Field of Classification Search ..... 160/84.05, 160/121.1, 120, 87, 168.1 R; 139/383 R, 139/384 R, 387 R, 384 A, 408–415, 420 R, 139/426 R, 383 B, 391, 394, 423, DIG. 1
See application file for complete search history.

(56) References Cited

U.S. PATENT DOCUMENTS

| | | | | | |
|---|---|---|---|---|---|
| 1,937,342 | A | * | 11/1933 | Higbie | 359/596 |
| 2,140,049 | A | * | 12/1938 | Grauel | 160/121.1 |
| 2,801,456 | A | * | 8/1957 | Walters et al. | 28/158 |
| 2,856,324 | A | * | 10/1958 | Janowski | 156/65 |
| 3,384,519 | A | * | 5/1968 | Froget | 156/65 |
| 4,019,554 | A | * | 4/1977 | Rasmussen | 160/84.02 |
| 5,285,838 | A | * | 2/1994 | Rapp et al. | 160/168.1 R |
| 5,419,385 | A | * | 5/1995 | Vogel et al. | 160/121.1 |
| 5,454,414 | A | * | 10/1995 | Colson et al. | 160/84.02 |
| 5,558,925 | A | * | 9/1996 | Fritzman | 428/181 |
| 5,664,613 | A | * | 9/1997 | Jelic | 160/84.05 |
| 5,691,031 | A | * | 11/1997 | Swiszcz et al. | 428/116 |
| 5,753,338 | A | * | 5/1998 | Jelic et al. | 428/116 |
| 6,302,982 | B1 | * | 10/2001 | Corey et al. | 156/73.4 |
| 6,377,384 | B2 | * | 4/2002 | Corey et al. | 359/227 |
| 6,484,786 | B1 | * | 11/2002 | Ruggles et al. | 160/84.05 |

(Continued)

FOREIGN PATENT DOCUMENTS

KR 2000-0019200 A 4/2000

(Continued)

*Primary Examiner* — Katherine W Mitchell
*Assistant Examiner* — Jaime F Cardenas-Garcia
(74) *Attorney, Agent, or Firm* — Sughrue Mion, PLLC

(57) ABSTRACT

A three-dimensional fabric with three-layered structure is provided. The three-dimensional fabric comprises a surface layer, a backing layer, an intermediate layer, a first interconnection portion for connecting the surface layer and the backing layer, and a second interconnection portion for connecting the intermediate layer and the backing layer. The three-dimensional fabric with three-layered structure can be woven on a single loom in a batch operation and undergo transformation between two-dimensional shape and three-dimensional shape. This fabric is applicable as materials for blinds with high light-shielding rate because intermediate portions have a multi-layered structure.

14 Claims, 8 Drawing Sheets

U.S. PATENT DOCUMENTS

| | | | | |
|---|---|---|---|---|
| 6,575,222 | B2 * | 6/2003 | Corey et al. | 160/84.05 |
| 6,634,409 | B2 * | 10/2003 | Corey et al. | 160/236 |
| 6,729,379 | B1 * | 5/2004 | Nien | 160/121.1 |
| 6,745,811 | B1 * | 6/2004 | Nien | 160/121.1 |
| 6,823,923 | B2 * | 11/2004 | Palmer et al. | 160/84.05 |
| D600,057 | S * | 9/2009 | Cha | D6/575 |
| 7,694,696 | B2 * | 4/2010 | Chang et al. | 139/423 |
| 2004/0074611 | A1 * | 4/2004 | Colson et al. | 160/84.05 |
| 2004/0226663 | A1 * | 11/2004 | Smith et al. | 160/84.05 |
| 2005/0194104 | A1 * | 9/2005 | Nien | 160/84.05 |
| 2007/0079943 | A1 * | 4/2007 | Smith et al. | 160/121.1 |
| 2007/0272368 | A1 * | 11/2007 | Hoffmann et al. | 160/121.1 |
| 2009/0288731 | A1 * | 11/2009 | Chang et al. | 139/383 R |

FOREIGN PATENT DOCUMENTS

| | | | |
|---|---|---|---|
| KR | 2001-0061906 | A | 7/2001 |
| KR | 10-0815579 | B1 | 3/2008 |

* cited by examiner

THREE-DIMENSIONAL FABRIC WITH THREE-LAYERED STRUCTURE

TECHNICAL FIELD

The present invention relates to fabrics that can create three-dimensional shapes with three-layered structure and methods for the production of the fabrics. More specifically, the present invention relates to fabrics, particularly fabrics applicable as materials for blinds with high light-shielding rate and heat-insulating efficiency due to intermediate portions having a multi-layered structure, that can be woven on a single loom in a batch operation by novel weaving techniques and undergo transformation between two-dimensional and three-dimensional shapes, and methods for the production of the fabrics.

BACKGROUND ART

Fabrics are typically made from corresponding raw materials and are constructed by weaving, knitting, plaiting or braiding. For example, felt fabrics are produced by the interlocking of fibers. Fabrics are primarily classified into woven fabrics, knitted fabrics, felt fabrics, plaited fabrics, non-woven fabrics, laminated fabrics and molded fabrics by standard production methods thereof.

In a narrow sense, woven fabrics refer to fabrics constructed by interlacing vertical warp threads with horizontal weft threads at right angles. Woven fabrics are the most widely used fabrics for under wears and outer wears. Knitted fabrics are constructed by making sets of threads into loops and combining the loops with one another in forward, backward, left and right directions. Knitted fabrics are rapidly produced by knitting and tend to be loose and elastic when being worn. Strands of fibers are interlocked by heat, moisture, pressure or striking to construct felt fabrics, thus eliminating the need for the use of threads. In plaited, braided and lace fabrics, individual threads are interlaced with sets of threads while sliding in any one direction to attain desired effects. Non-woven fabrics are constructed by the application of adhesive materials, the attachment of fibers through chemical functions on the surface of the fibers, or the attachment of webs or sheets of thermoplastic fibers by heating. Laminated fabrics are constructed by laminating a foam to one or two woven fabrics to achieve improved flexibility and provide a cushiony feeling. The surface areas of molded fabrics are larger than those of the raw materials before extrusion. Molded articles (e.g., clothes) are cushiony, or are in the form of a pile or plate. These articles are very wearable, match the functions of the human body, and are not readily deformed.

The lateral sides of two-dimensional fabrics are not utilized or used. Sewing and other fusion techniques are currently used to impart three-dimensional shapes to fabrics.

Industrial applications of such techniques have been reported. For example, U.S. Pat. No. 3,384,519 suggests a blind comprising two-layered fabrics and a movable blade positioned between the fabrics wherein the fabrics and blade are adhered to the blade by fusion or bonding. The horizontal movement of the blade allows light to enter through the mesh type fabrics, and the vertical movement of the blade blocks light. By the movements of the blade, the amount of light entering the blind can be controlled. In addition, the soft texture and mesh structure of the fabrics enable the blind to shield light in a controllable manner. However, the use of an adhesive or pressure-sensitive adhesive for the adhesion of the blade to the fabrics may cause the problems of indoor environmental pollution. Particularly, long-term use of the blind causes a deterioration in the physical properties of the adhesive or pressure-sensitive adhesive by UV light, resulting in poor adhesion between the blade and the fabrics. In serious cases, the blade is separated from the fabrics.

In an attempt to overcome the above problems, a three-dimensional fabric is suggested in Korean Patent No. 10-0815579. The three-dimensional fabric includes a surface layer, a backing layer, and an intermediate layer connecting the surface layer and the backing layer. The intermediate layer is composed of first intermediate portions and second intermediate portions. The surface layer includes sequential unstitched surface portions and sequential stitched surface portions formed in an alternating and repeating pattern. The unstitched surface portions are essentially composed of surface warp threads only and the stitched surface portions are composed of the surface warp threads and intermediate warp threads. The backing layer includes sequential unstitched backing portions and sequential stitched backing portions formed in an alternating and repeating pattern. The unstitched backing portions are essentially composed of backing warp threads only and the stitched backing portions are composed of the backing warp threads and the intermediate warp threads. The intermediate layer includes sequential intermediate portions composed of the intermediate warp threads only and connected to the stitched surface portions and the stitched backing portions in an alternating and repeating pattern.

However, there are still many problems in the above-mentioned three-dimensional fabrics. The structure of the fabrics is simple such that they are composed of a backing layer, and intermediate layer, and a surface layer, so that it is impossible to display various scenes. In the event that the surface layer and backing are formed into a mesh structure, only intermediate layer should shield light. The greatest problem of the patent is that the intermediate portions of the three-dimensional fabric have a single-layer structure, so that it is impossible for light to be shield completely. Therefore, the patented fabric is not applicable in various fields such as movie theaters, lecture rooms, presentation rooms, laboratories, and so forth in which light should be shield perfectly.

DISCLOSURE

Technical Problem

The present invention has been made in an effort to solve the above problems, and it is an object of the present invention to provide fabrics that can be woven on a single loom in a batch operation by novel weaving techniques and undergo transformation between two-dimensional and three-dimensional shapes, and are applicable as materials for blinds with high light-shielding rate that is controllable and keep-warming due to intermediate portions having a multi-layered structure and, and methods for the production of the fabrics.

Technical Solution

Embodiments of the present invention provide a three-dimensional fabric with three-layered structure, comprising a surface layer, a backing layer, an intermediate layer, a first interconnection portion for connecting the surface layer and the backing layer, and a second interconnection portion for connecting the intermediate layer and the backing layer, wherein the first and second interconnection portions are positioned at the same angle.

Embodiments of the present invention provide a three-dimensional fabric with three-layered structure, comprising a backing layer, an intermediate layer, a surface layer, a first connecting portion connecting the backing layer and the intermediate layer, and a second connecting portion connecting the intermediate layer and the surface layer wherein warp threads sequentially form the backing layer, the first connecting portion, the intermediate layer, the second connecting portion, and the surface layer, and then connected to the backing layer to form connecting warp threads and again form the backing layer in an alternating and repeating pattern, and the warp threads are sequentially and simultaneously woven from each of the backing layer, the first connecting portion, the intermediate layer, the second connecting portion, and the surface layer, followed by cutting the connecting warp threads.

In some embodiments of the present invention, protrusion portions exposed to a surface of fabrics by the warp threads woven without interlacing with weft threads are formed in the surface layer.

In other embodiments of the present invention, the first and second connecting portions are woven at the same angle.

Embodiments of the present invention provide a three-dimensional fabric with three-layered structure, comprising a backing layer, an intermediate layer, a surface layer, a first connecting portion connecting the backing layer and the intermediate layer, and a second connecting portion connecting the intermediate layer and the surface layer wherein warp threads sequentially form the backing layer, the first connecting portion, the intermediate layer, the second connecting portion, and the surface layer, and then connected to the backing layer to form connecting warp threads and again form the backing layer in an alternating and repeating pattern, and when warp threads started from the backing layer are 1/2/3/4, warp threads from the first connecting portion are 5/6, warp threads started from the intermediate layer are 7/8, warp threads started from the second connecting portion are 9/10, and warp threads started from the surface layer are 11/12/13/14, as indicated by harness numbers, and the warp threads a 1/2/3/4 form the backing layer and then the surface layer, and when the warp threads are 1/2/3/4 in contact with the warp threads are 13/14 forming the connecting warp threads toward the backing layer, the warp threads 3/4 form the first connecting portion, and the warp threads 1/2/13/14 form the backing layer. The warp threads 5/6 form the first connecting portion and woven with the warp threads 7/8 forming the intermediate layer to form stitched intermediate portions, and then the warp threads 5/6 form the intermediate layer and the warp threads 7/8 form the second connecting portion. The warp threads 11/12/13/14 form the surface layer and woven with the warp threads 9/10 forming the second connecting portion to form stitched surface portions, and then the warp threads 13/14 is connected to the backing layer and the warp threads 9/10/11/12 form the surface layer, followed by cutting the warp threads.

Embodiments of the present invention provide a three-dimensional fabric with three-layered structure, comprising a surface layer, an intermediate layer, a backing layer, a first connecting portion connecting the surface layer and the intermediate layer, and a second connecting portion connecting the intermediate layer and the backing layer, wherein the first and second connecting portions are woven symmetrically on the intermediate layer.

Embodiments of the present invention provide three-dimensional fabric with three-layered structure, comprising a backing layer, an intermediate layer, a surface layer, a first connecting portion connecting the backing layer and the intermediate layer, and a second connecting portion connecting the intermediate layer and the surface layer. Warp threads comprises a first group warp threads sequentially forming the backing layer, the first connecting portion, and then connected to the backing layer to form first connecting warp threads and again forming the backing layer in an alternating and repeating pattern and a second group warp threads sequentially forming the surface layer, the second connecting portion, and the intermediate portion then connected to the surface layer to form second connecting warp threads and again forming the surface layer in an alternating and repeating pattern. The first group warp threads are sequentially and simultaneously woven from each of the backing layer and the first connecting portion, the second group warp threads are sequentially and simultaneously woven from each of the intermediate layer, the second connecting portion, and the surface layer, followed by cutting the first and second connecting warp threads.

In some embodiments of the present invention, surface protrusion portions and the backing protrusion portions exposed on a surface of fabrics by the first and second warp threads woven without interlacing with weft threads are formed in the backing layer.

In other embodiments of the present invention, the first and second connecting portions are woven symmetrically on the intermediate layer.

Embodiments of the present invention provide a three-dimensional fabric with three-layered structure, comprising a backing layer, an intermediate layer, a surface layer, a first connecting portion connecting the backing layer and the intermediate layer, and a second connecting portion connecting the intermediate layer and the surface layer. Warp threads comprises a first group warp threads sequentially forming the backing layer, the first connecting portion, and then connected to the backing layer to form first connecting warp threads and again forming the backing layer in an alternating and repeating pattern and second group warp threads sequentially forming the surface layer, the second connecting portion, and the intermediate portion then connected to the surface layer to form second connecting warp threads and again forming the surface layer in an alternating and repeating pattern. When first group warp threads started from the backing layer are 1/2/3/4, a first group warp threads from the first connecting portion are 5/6, a second group warp threads started from the intermediate layer are 7/8, a second group warp threads started from the second connecting portion are 9/10, and a second group warp threads started from the surface layer are 11/12/13/14, as indicated by harness numbers, and the warp threads are 1/2/3/4 form the backing layer and then the first connecting portion and first connecting warp threads, and when the warp threads are 1/2/3/4 in contact with the warp threads are 5/6 in contact with warp threads connected to the backing layer, the warp threads 3/4 form the first connecting portion, and the warp threads 1/2/5/6 form the backing layer. The warp threads 5/6 form the first connecting portion and woven with the warp threads 7/8 forming the intermediate layer and warp threads 9/10 forming the second connecting portion to form stitched intermediate portions, and then the warp threads 5/6 form the first connecting warp threads, the warp threads 7/8 form the second connecting warp threads, and the warp threads 9/10 form the intermediate layer. The warp threads 11/12/13/14 form the surface layer, and then when the warp threads 11/12/13/14 are in contact with the warp threads 7/8, the warp threads 13/14 form the second connecting portion and warp threads 7/8/11/12 form the surface layer, followed by cutting the first and second connecting warp threads.

In some embodiments of the present invention, the warp thread and/or the weft thread is woven with a low-melting point yarn.

In other embodiments of the present invention, the warp thread and/or the weft thread is a grey yarn in which a low-melting point yarn and a flame-retardant yarn are mixed or a composite fiber composed of low-melting point portions and flame-retardant portions.

In further embodiments of the present invention, the surface layer, the intermediate layer, and the backing layer are formed into a mesh structure by weaving.

In other embodiments of the present invention, the first and second connecting portions are denser than the surface layer, the intermediate layer, and the backing layer.

In yet other embodiments of the present invention, the fabric is further thermally treated to achieve improved shape stability and enhanced stiffness.

In further embodiments of the present invention, the surface layer and the backing layer are formed into a mesh structure by weaving.

In other embodiments of the present invention, the intermediate layer is denser than the surface layer and the backing layer.

In further embodiments of the present invention, a blind is provided using the three-dimensional fabric with three-layered structure.

Advantageous Effects

The fabrics and the methods according to the embodiments of the present invention have the following advantageous effects.

The fabrics can be transformed from two-dimensional shape to and three-dimensional shape according to a conventional weaving method. The three-dimensional fabric with three-layered structure according to the present invention can shield light perfectly due to intermediate portions having a multi-layered structure so that it is applicable in various fields such as movie theaters, lecture rooms, presentation rooms, laboratories, and so forth in which light should be shield perfectly.

Additionally, the design, color depth and light-shielding effects of the fabrics can be effectively varied through the transformation between two-dimensional and three-dimensional shapes.

Furthermore, according to the present invention, in case that a blind is manufactured with five-layered is used, heat insulting and keep-warming efficiency can be dramatically improved.

BRIEF EXPLANATION OF ESSENTIAL PARTS OF THE DRAWINGS

Figure 1:
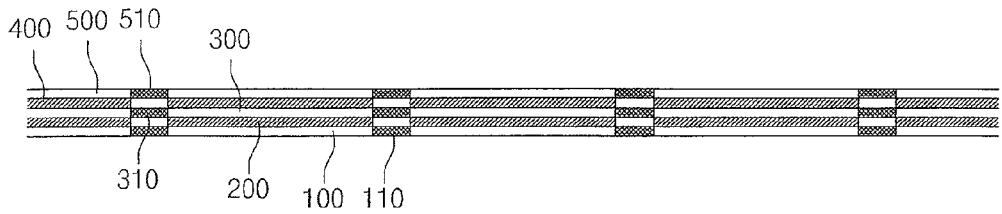
FIG. 1 is a cross-sectional view of a fabric according to a preferred embodiment of the present invention along the running direction of warp threads.
Figure 2:
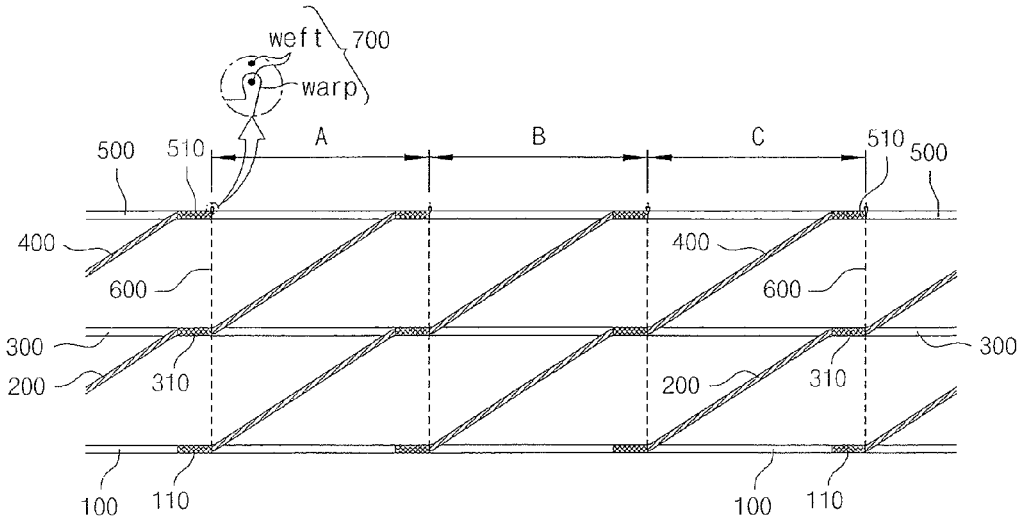
FIG. 2 is a conceptual sectional view illustrating the production of the fabric according to a first embodiment of the present invention.

| | |
|---|---|
| 100: Backing layer | 110: Stitched backing portions |
| 200: First Connection Portion | 300: Intermediate Layer |
| 310: Stitched Intermediate portions | 400: Second Connection Portion |
| 500: Surface Layer | 510: Stitched surface portions |
| 600: Connection Warp Threads | 610: First Connection Warp Threads |
| 630: Second Connection Warp Threads | 700: Protrusion Portions |
| 710: Backing Protrusion Portions | 730: Surface Protrusion Portions |

BEST MODE

Preferred embodiments of the present invention will now be described in detail with reference to the accompanying drawings. It should be noted that whenever possible, the same reference numerals will be used throughout the drawings and the description to refer to the same or like parts. In describing the present invention, detailed descriptions of related known functions or configurations are omitted in order to avoid making the essential subject of the invention unclear.

As used herein, the terms "about", "substantially", etc. are intended to allow some leeway in mathematical exactness to account for tolerances that are acceptable in the trade and to prevent any unconscientious violator from unduly taking advantage of the disclosure in which exact or absolute numerical values are given so as to help understand the invention.

The term "fabrics" is defined to include woven fabrics, knitted fabrics, felt fabrics, plaited fabrics, non-woven fabrics, laminated fabrics and molded fabrics. Woven fabrics are exemplified in order to better understand the embodiments of the present invention. Thus, it is to be understood that the woven fabrics are produced by the interlacing of warp threads and weft threads. The expression "warp threads only are woven" is used herein to mean that the warp threads are interlaced with weft threads, but the expression 'not interlaced with weft threads' is not applied thereto.

The three-dimensional fabric with three-layered structure can be formed in a three-layered structure. In actuality, the fabrics are formed as illustrated FIG. 1, for convenience of explanation, a backing layer 100, a first connecting portion 200, an intermediate layer 300, a second connecting layer 400, and a surface layer 500 are separated as shown FIGS. 2 to 7.

As shown in FIGS. 2 to 7, a three-dimensional fabric with three-layered structure according to the present invention comprises a surface layer, a backing layer, an intermediate layer, a first interconnection portion for connecting the surface layer and the backing layer, and a second interconnection portion for connecting the intermediate layer and the backing layer.

Figure 6:
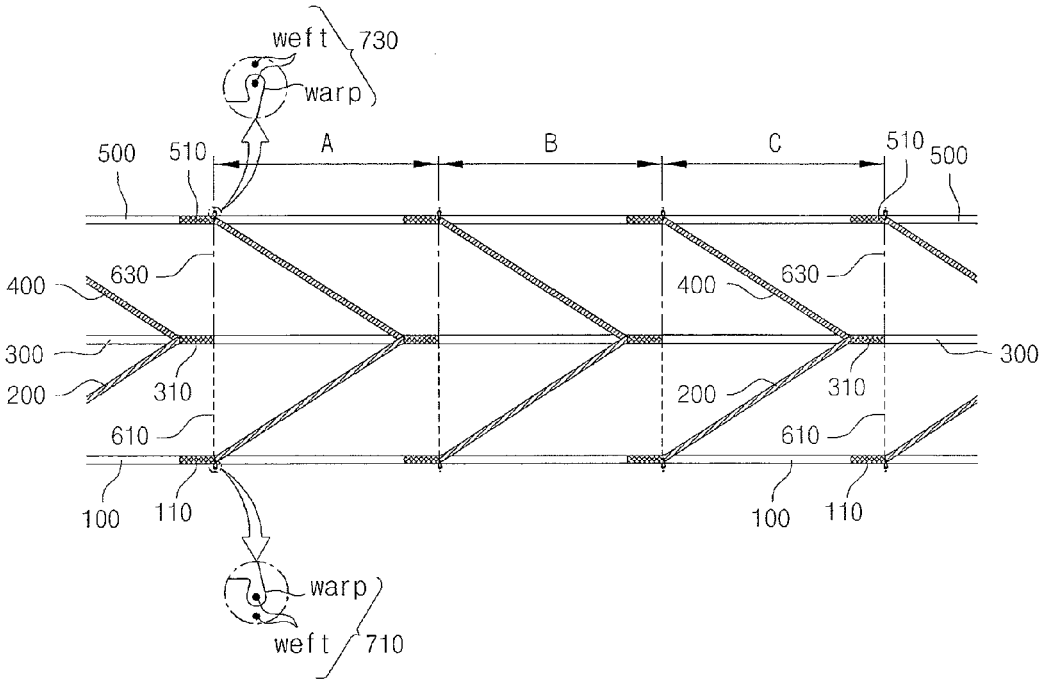
FIG. 6 is a conceptual sectional view illustrating the production of the fabric according to a second embodiment of the present invention.
Figure 7:
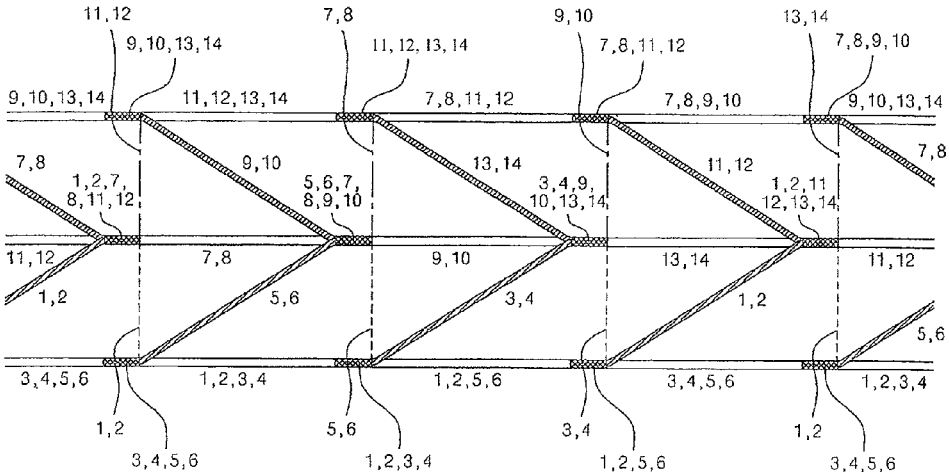
FIG. 7 is a conceptual sectional view illustrating the production of the fabric as indicated by warp threads numbers according to a second embodiment of the present invention.

The first and second interconnection portions 200 and 400 may be positioned at the same angle as shown in FIGS. 2 to 5. They are woven symmetrically on the intermediate layer 300 as shown in FIGS. 6 and 7.

As shown in FIGS. 2 to 5, warp threads forming three-dimensional fabric according to a first embodiment sequentially form the backing layer 100, the first connecting portion 200, the intermediate layer 300, the second connecting portion 400, and the surface layer 500, and then connected to the backing layer 100 to form connecting warp threads 600 and again form the backing layer 100 in an alternating and repeating pattern.

The warp threads are sequentially and simultaneously woven from each of the backing layer 100, the first connecting portion 200, the intermediate layer 300, the second connecting portion 400, and the surface layer 500. In other words, warp threads forming three-dimensional fabric according to a first embodiment are woven by the same ways. However, the start points of the warp threads are different and each of them sequentially processed to form the three-dimensional fabric with three-layered structure.

In accordance with the present invention, warp threads forming the intermediate layer 300 are in contact with warp threads forming the first connecting portion 200 to form stitched intermediate portions 310, and warp threads forming the surface layer 500 are in contact with warp threads forming the second connecting portion 400 to form stitched surface portions 510. Warp threads forming the backing layer 100 are in contact with warp threads forming the surface layer 500 as connecting warp threads 600 to form stitched backing portions 110 and warp threads forming the intermediate layer 300 are in contact with warp threads forming the first connecting portion 200 to form stitched intermediate portions 310.

Stitched portions are denser than any other portions, so that dimensional stability of the three-dimensional fabric with three-layered structure can be improved. In the present invention, the stitched portions may not be formed on the backing layer 100 or the surface layer depending on the weaving method. Accordingly, it is preferable that the stitched backing portion 110 or the stitched surface portions 510 are formed using thick weft threads or making the backing layer 100 and the surface layer 500 more dense when the stitched portions are not formed.

Figure 4:
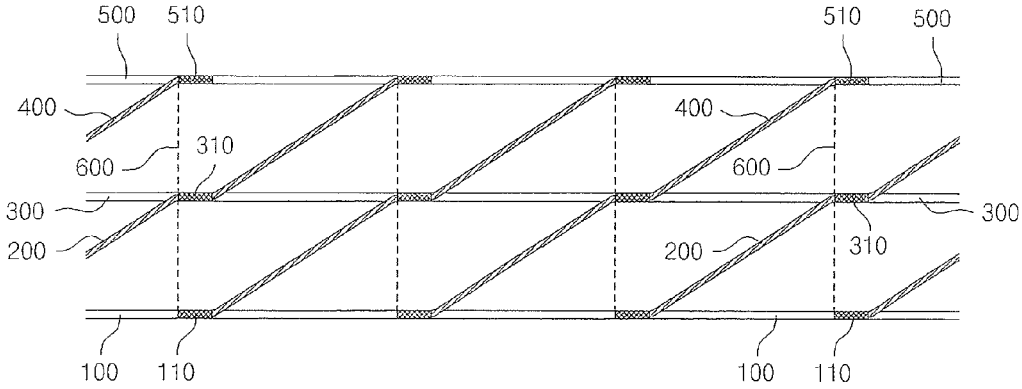
FIG. 4 is a conceptual sectional view illustrating another production of the fabric according to a first embodiment of the present invention.

According to the first embodiment of the present invention, fabrics are composed of A zone including the first connecting portion 200 and second connecting portion 400 of FIG. 4, which is repeatedly formed. The warp threads forming three-dimensional fabric according to a first embodiment forms the backing layer 100 in two zones, and then the first connecting portion 200, the intermediate layer 300, and the second connecting portion 400, and then the surface layer 500 in two zones. After that, the warp threads forming three-dimensional fabric according to the first embodiment is again connected to the backing layer. Such process is sequentially and simultaneously performed from each of the backing layer 100, the first connecting portion 200, the intermediate layer 300, the second connecting portion 400, and the surface layer 500.

Figure 3:
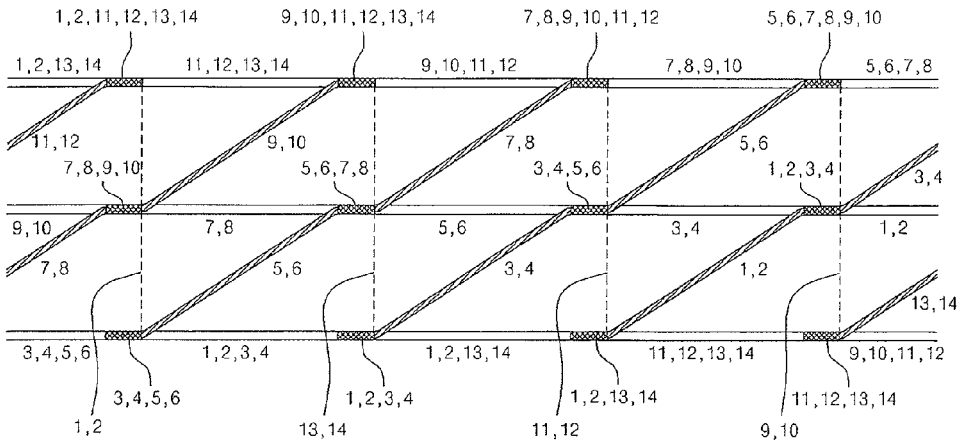
FIG. 3 is a conceptual sectional view illustrating the production of the fabric as indicated by warp threads numbers according to a first embodiment of the present invention.

In FIG. 3, the method for weaving the fabric according to the first embodiment of the present invention is simplified as indicated by harness numbers. When warp threads started from the backing layer are 1/2/3/4, warp threads from the first connecting portion are 5/6, warp threads started from the intermediate layer are 7/8, warp threads started from the second connecting portion are 9/10, and warp threads started from the surface layer are 11/12/13/14. First, the weaving in zone A will be explained.

The warp threads 1/2/3/4 form the backing layer 100 as predetermined length and then the surface layer 500 having the same length as the backing layer 100, and when the warp threads are 1/2/3/4 in contact with the warp threads are 13/14 forming the connecting warp threads toward the backing layer, the warp threads 3/4 form the first connecting portion 200, and the warp threads 1/2/13/14 continuously form the backing layer 100.

The warp threads 5/6 form the first connecting portion 200 and woven with the warp threads 7/8 forming the intermediate layer 300 to form stitched intermediate portions 310. After that, the warp threads 5/6 form the intermediate layer 300, and the warp threads 7/8 form the second connecting portion 400.

The warp threads 11/12/13/14 form the surface layer 500 and woven with the warp threads 9/10 forming the second connecting portion 400 to form stitched surface portions 510, and then the warp threads 13/14 is connected to the backing layer 100 and the warp threads 9/10/11/12 continuously form the surface layer 500.

The weaving in zones B and C is the same as in zone A except that warp threads numbers. Therefore, the three-dimensional fabric with three-layered structure can be formed.

The above-mentioned weaved fabric can not materialize three-dimension shape since the backing layer 100 is connected to the surface layer 500 by the connecting warp threads 600. Accordingly, in order to obtain three-dimensional fabrics, it is necessary to remove the connecting warp threads 600.

Figure 8:
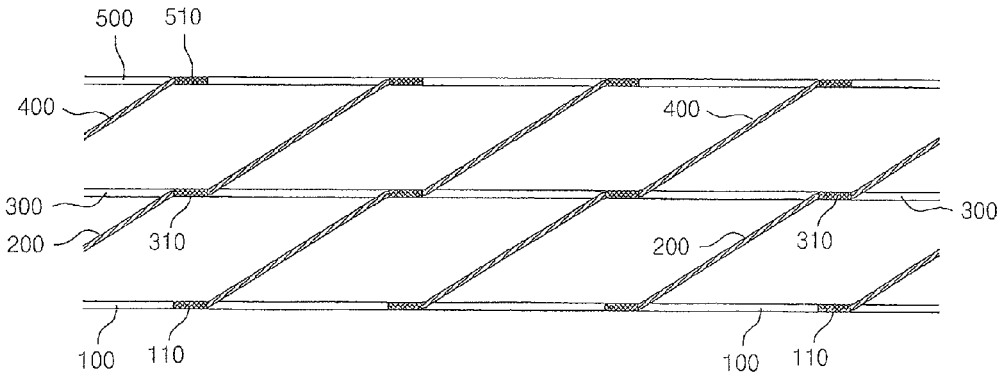
FIG. 8 is a conceptual sectional view illustrating the production of the fabric after cutting according to the first embodiment of the present invention.

FIG. 8 shows fabrics without the connecting warp threads 600. By removing the connecting warp threads, the backing layer 100, the intermediate layer 300, and the surface layer 200 are connected by the first connecting portion 200 and the second connecting portion 400 each other to embody the three-dimensional fabric with three-layered structure.

To easily remove the above connecting warp threads 600, it is exposed on the surface layer to form the protrusion portion 700. With reference to a partial magnifying view of FIG. 2, the connecting warp threads 600 is covered with two wefts threads from top to bottom, so that the protrusion portion 700 formed to be exposed on the surface layer.

The connecting warp threads 600 exposed to the surface layer 500 are fixed by the weft threads. The weft threads are successively exposed together with the connecting warp threads 600 in the width direction. When it is intended to move upwardly and remove the weft threads exposed to the surface layer, the connecting warp 600 threads interlaced together with the weft threads are also moved upwardly and cut at the respective stitched portions. As a result, the connecting warp threads 600 can be completely removed together with the weft threads.

In the three-dimensional fabric with three-layered structure according to the present invention, the stitched intermediate portion 310 and the stitched surface portion 510 are formed in the intermediate layer 300 and the surface layer 500, respectively.

Figure 5:
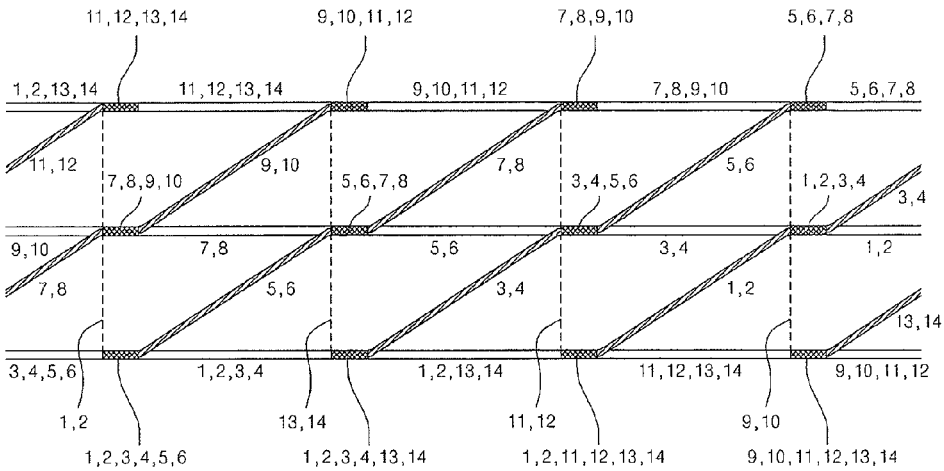
FIG. 5 is a conceptual sectional view illustrating another production of the fabric as indicated by warp threads numbers according to a first embodiment of the present invention.

FIGS. 4 and 5 are conceptual sectional views illustrating another production of the fabric according to a first embodiment of the present invention. With reference to FIGS. 4 and 5, the three-dimensional fabric with three-layered structure comprises the stitched backing portions 110 and the stitched intermediate portions 310. According to the present embodiment, warp threads forming three-dimensional fabric form the backing layer 100 in two zones, and form the first connecting portion 200, the intermediate layer 300, the second connecting portion 400, and the surface layer 500 in two zones, and then connected to the backing layer to form the backing layer 100 in an alternating and repeating pattern. There is a difference in a point where the warp threads forming the surface layer 100 is connected to the surface layer 100 to form the connecting warp threads 600 when the warp threads are sequentially and simultaneously woven from each of the backing layer 100, the first connecting portion 200, the intermediate layer 300, the second connecting portion 400, and the surface layer 500.

For purposes of simplification, FIG. 5 shows another production of the fabric as indicated by harness numbers. When warp threads started from the backing layer 100 are 1/2/3/4, warp threads from the first connecting portion 200 are 5/6, warp threads started from the intermediate layer 300 are 7/8, warp threads started from the second connecting portion 400 are 9/10, and warp threads started from the surface layer 500 are 11/12/13/14, as indicated by harness numbers, and the warp threads 1/2/3/4 form the backing layer 100 and then the surface layer 500, and when the warp threads are 1/2/3/4 in contact with the warp threads are 13/14 forming the connecting warp threads in the backing layer 100 to form stitched backing portions 110, the warp threads 3/4 form the first connecting portion, 200 and the warp threads 1/2/13/14 form the backing layer 100.

The warp threads 5/6 form the first connecting portion 200 and woven with the warp threads 7/8 forming the intermediate layer 300 to form stitched intermediate portions 310, and then the warp threads 5/6 form the intermediate layer 300 and the warp threads 7/8 form the second connecting portion 400.

When the warp threads 11/12/13/14 form the surface layer 500 and woven with the warp threads 9/10 forming the second connecting portion 400, the warp threads 13/14 is connected to the backing layer 100 and the warp threads 9/10/11/12 form the surface layer 500. The fabric according to the above embodiment should remove the connecting warp threads 600 as the above embodiment. The method of removing the connecting warp threads 600 is performed as the above-mentioned method.

In the three-dimensional fabric with three-layered structure according to the first embodiment of the present invention n, the protrusion portions are formed on the surface layer 500 to easily remove the connecting warp threads.

Figure 9:
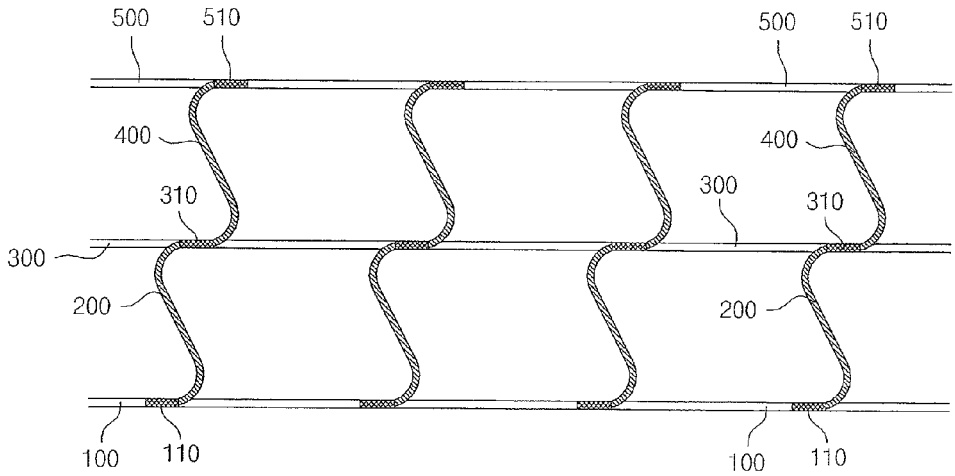
FIG. 9 is a three-dimensional expression of the fabric according to a first embodiment of the present invention.
Figure 10:
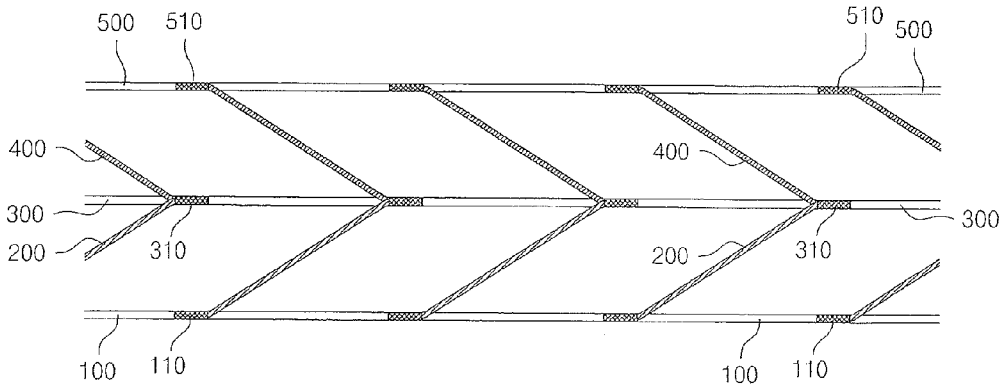
FIG. 10 is a conceptual sectional view of the production of the fabric after cutting according to a second embodiment of the present invention.

By removing the connecting warp threads of the three dimensional fabric according to the first embodiment, the three-dimensional fabric with three-layered structure can be embodied as shown in FIG. 9.

Figure 12:
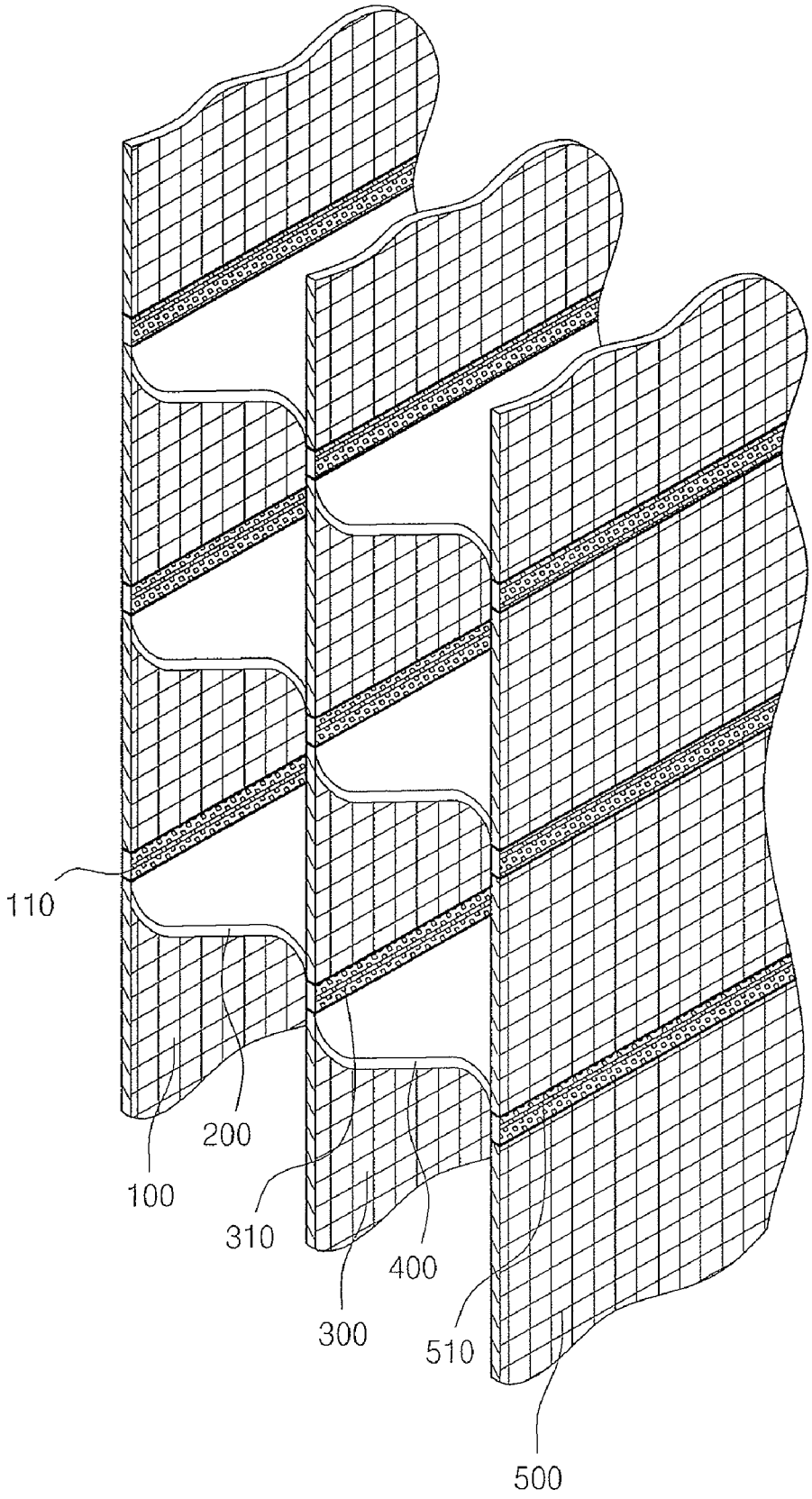
FIG. 12 shows an example of three-dimensional fabric with three-layered structure according to a first embodiment of the present invention.

FIG. 12 shows an example of three-dimensional fabric with three-layered structure according to a first embodiment of the present invention. In detail, three dimensional shape is embodied on fabrics by raising the surface layer 500.

In the three-dimensional fabric with three-layered structure as the explanation of the first embodiment, the first connecting portions 200 and second connecting portions 400 are woven at the same angle. In contrast, they are woven symmetrically on the intermediate layer 300.

With reference to FIGS. 6 and 7, the three-dimensional fabric with the symmetrical structure of the first and second connecting portions 200 and 400 according to the second embodiment is formed by repeating A zone which includes one first connecting portion 200 and second connecting portion 400 of FIG. 6.

The warp threads according to the second embodiment comprise a first group warp threads and a second group warp threads. The first group warp threads sequentially forming the backing layer 100, the first connecting portion 200, and then connected to the backing layer 100 to form first connecting warp threads 610 and again forming the backing layer 100. The second group warp threads sequentially forming the surface layer 500, the second connecting portion 400, and the intermediate portion 300, and then connected to the surface layer 500 to form second connecting warp threads 630 and again forming the surface layer 500. Such the first and second group warp threads are formed in an alternating and repeating pattern.

The first group warp threads are sequentially and simultaneously woven from each of the backing layer 100 and the first connecting portion 200, and the second group warp threads are sequentially and simultaneously woven from each of the intermediate layer 300, the second connecting portion 400, and the surface layer 500.

Three-layered structure should be formed by connecting the first and second group warp threads through the junction of the first connecting portions 200 and the second connecting portions 400. In this case, the first connecting portions 200 are bonded with the second connecting portions 400 in the intermediate layer 300. In the intermediate layer 300, it is preferable that the warp threads forming the first and second connecting portions 200 and 400 are bonded with the warp threads forming the intermediate layer 300 to form the stitched intermediate portions. Resultantly, the three-dimensional fabric with three-layered structure is formed by bonding the warp threads of the first and second group warp threads.

The stitched intermediate portions 310 become denser than any other portions to improve dimensional stability of the three-dimensional fabric with three-layered structure. In the present invention, stitched portions are not formed on the backing layer 100 and the surface layer 500. Accordingly, as shown in FIGS. 6 and 7, the stitched backing portion 110 or the stitched surface portions 510 are formed using thick weft threads or making the backing layer 100 and the surface layer 500 more dense so as to improve dimensional stability of fabrics.

The three-dimensional shape of fabrics woven with the warp threads of the first and second group warp threads is embodied by cutting the first and second connecting warp threads after weaving.

For purposes of simplification, FIG. 7 shows another production of the fabric as indicated by harness numbers according to the second embodiment of the present invention.

When warp threads started from the backing layer are 1/2/3/4, warp threads from the first connecting portion are 5/6, warp threads started from the intermediate layer are 7/8, warp threads started from the second connecting portion are 9/10, and warp threads started from the surface layer are 11/12/13/14. First, the weaving in zone A will be explained.

The warp threads 1/2/3/4 form the backing layer 100 as predetermined length and then the first connection portion 200 is formed and the first connecting warp threads 610 is formed. When the warp threads are 1/2/3/4 in contact with the warp threads are 5/6 connected to the backing layer, the warp threads 3/4 form the first connecting portion 200, and the warp threads 1/2/5/6 form the backing layer 100.

The warp threads 5/6 form the first connecting portion 200 and woven with the warp threads 7/8 forming the intermediate layer 300 and the warp threads 9/10 forming the second connecting portion 400 to form stitched intermediate portions 310. After that, the warp threads 5/6 form the first connecting warp threads 610, the warp threads 7/8 form the second connecting warp threads 630, and the warp threads 9/10 form the intermediate layer 300.

When the warp threads 11/12/13/14 form the surface layer 500 and woven with the warp threads 7/8 forming the second connecting warp threads 630 and connected to the surface layer 500, the warp threads 13/14 form the second connecting portion 400 and the warp threads 7/8/11/12 form the surface layer 500.

The weaving in zones B and C is the same as in zone A except that warp threads numbers. Therefore, the three-dimensional fabric with three-layered structure can be formed.

That is, after the first group warp threads form the backing layer 100 in two zones and the first connecting portion 200, it is in contact with the backing layer 100 through the first connecting warp threads 610 to form the backing layer 100 in three zone periodically. After the second group warp threads form the surface layer 500 in two zones and the second connecting portion 400 and the intermediate layer 300, it is in contact with the surface layer 500 again through the second connecting warp threads to form the surface layer 500 in four zone periodically.

The above-mentioned weaved fabric can not materialize three-dimension shape since the backing layer 100 is connected to the surface layer 500 by the first and second connecting warp threads 610 and 630. Accordingly, in order to obtain three-dimensional fabrics, it is necessary to remove the first and second connecting warp threads 610 and 630 after weaving.

To easily remove the above the first and second connecting warp threads 610 and 630, they are exposed on the backing layer 100 and the surface layer 500 to form a backing protrusion portion 710 and a surface protrusion portion 730. With reference to a partial magnifying view of FIG. 6, the first and second connecting warp threads 610 and 630 are covered with two wefts threads from top to bottom, so that the backing protrusion portion 710 and the surface protrusion portion 730 are formed to be exposed on the backing layer 100 and the surface layer 500.

The first and second connecting warp threads 610 and 630 are fixed by the weft threads. As shown in FIG. 5, the weft threads are successively exposed together with the first and second connecting warp threads 610 and 630 in the width direction. When it is intended to move upwardly and remove the weft threads exposed to the surface layer, the first and second connecting warp threads 610 and 630 interlaced together with the weft threads are also moved upwardly and cut at the respective stitched portions. As a result, the first and second connecting warp threads 610 and 630 can be completely removed together with the weft threads.

Also, the connecting warp threads 600 of the first embodiment will be removed after forming protrusion portions in the same way as described above.

FIG. 8 shows fabrics without the first and second connecting warp threads 610 and 630. By removing the first and second connecting warp threads 610 and 630, the backing layer 100, the intermediate layer 300, and the surface layer 500 are connected by the first connecting portion 200 and the second connecting portion 400 each other to embody the three-dimensional fabric with three-layered structure.

Figure 11:
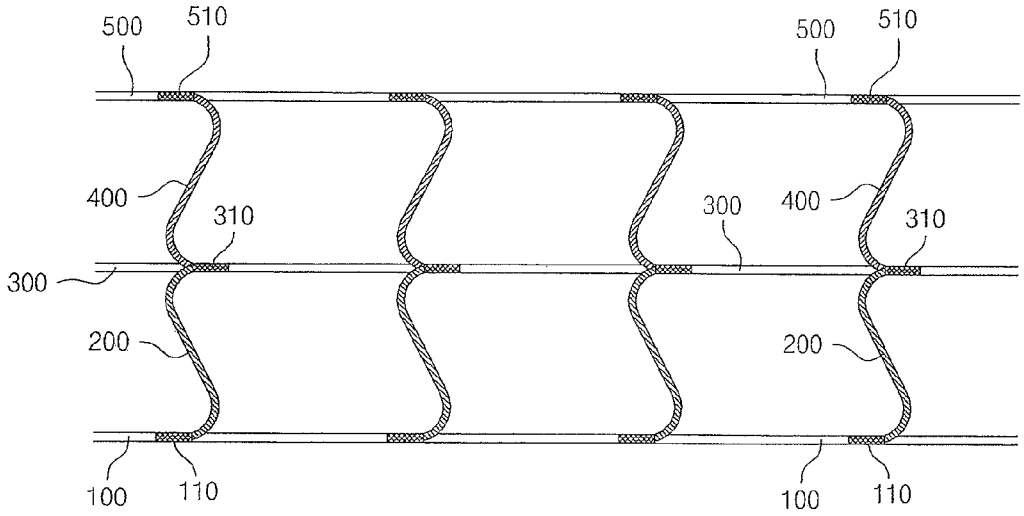
FIG. 11 is a three-dimensional expression of the fabric according to a second embodiment of the present invention.
Figure 13:
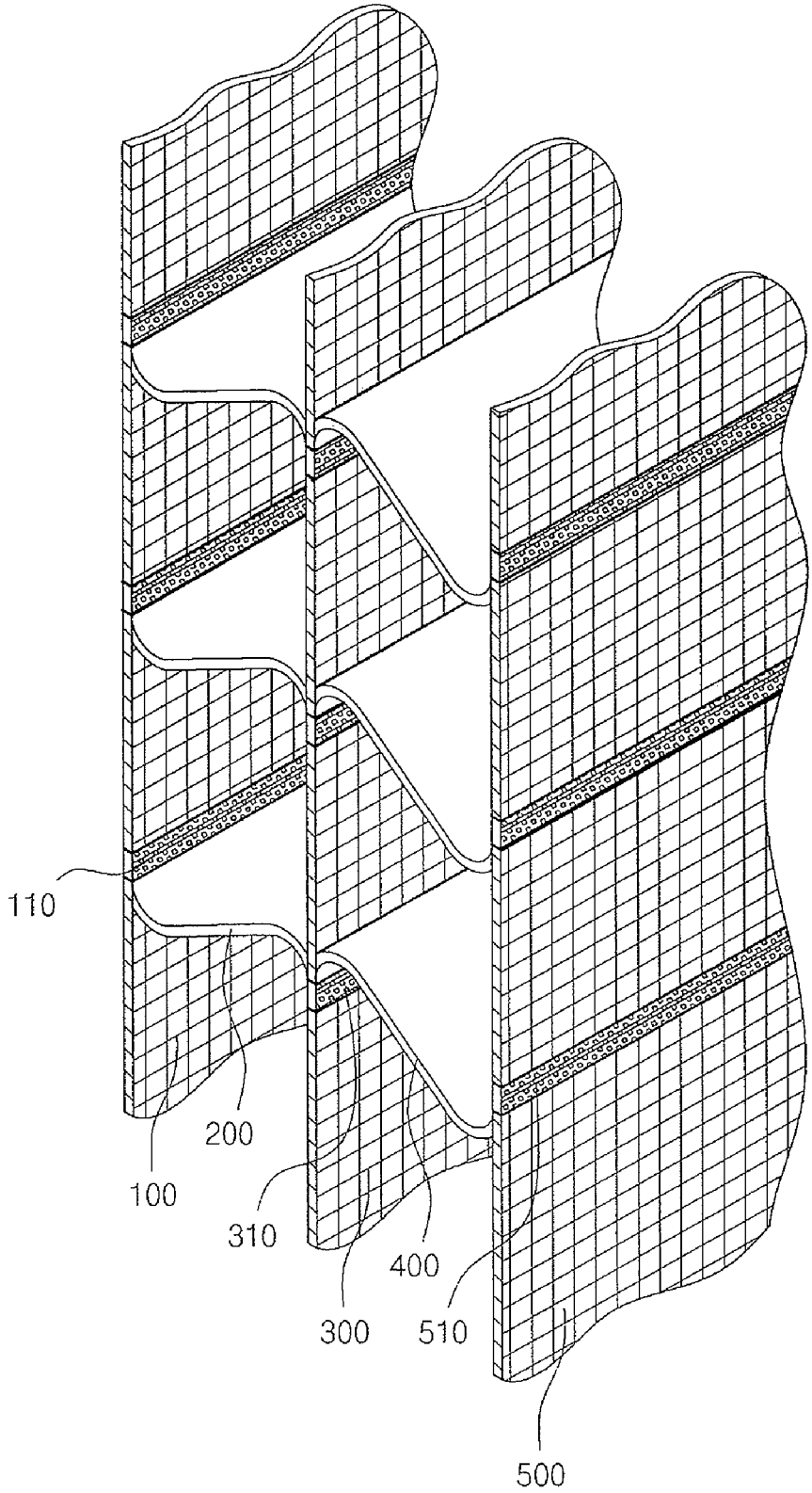
FIG. 13 shows another example of three-dimensional fabric with three-layered structure according to a second embodiment of the present invention.

FIG. 11 is a three-dimensional expression of the fabric by removing the connecting warp threads according to a second embodiment of the present invention. FIG. 13 shows another example of three-dimensional fabric with three-layered structure according to a second embodiment of the present invention and a three-dimensional expression of the fabric by raising the surface layer.

In the event that the three-dimensional fabric with three-layered structure is used as blinds, in accordance with the first embodiment of the present invention, shielding rate can be controlled by fixing the backing layer 100 and controlling the height of the intermediate layer 300 and the surface layer 500. In accordance with the second embodiment of the present invention, shielding rate can be controlled by fixing the backing layer 100 and controlling the height of the intermediate layer 300 and the surface layer 500 as well as by fixing the intermediate layer 300 and controlling the height of the backing layer 100 and the surface layer 500.

The fabric may be thermally treated before or after the shearing to achieve improved shape stability and enhanced stiffness. The thermal treatment is preferably carried out before shearing to make the fabric stiffer. When the thermal treatment is carried out after shearing, an excessive stress (e.g., cutting) is applied to the fabric in the state where the multiple layers are adhered, and as a result, the fabric may be damaged.

To avoid damage to the fabric, the warp thread and/or the weft thread is woven with a low-melting point yarn. As the low-melting point yarn, there may be used a grey yarn whose melting point is intentionally lowered by modification of molecular structure, copolymerization, blending, spinning process control or composite spinning so that the surface can be minutely fused by thermal treatment in the temperature range of about 120° C. to about 190° C. Specifically, as the grey yarn, Korean Patent No. 289414 suggests a copolyester-based binder fiber prepared by copolymerizing terephthalic acid or its ester-forming derivative, ethylene glycol and neopentyl glycol. Further, the low-melting yarn produced by composite spinning is composed of a core portion and a sheath portion. The core portion serves as a support and the sheath portion is fused during thermal treatment. As the low-melting yarn, Korean Patent No. 587122 suggests a heat-fusible composite fiber comprising a low-melting point ingredient and a high-melting point ingredient wherein the low-melting point ingredient forms continuously at least a part of the fiber surface in the fiber direction, has a glass transition temperature higher than 60° C. and is composed of a mixture of 1 to 20 wt % of polyolefin and 80 to 99 wt % of a copolyester having 50 to 70 mol % of polyethylene terephthalate units.

As the warp thread and/or the weft thread, there can be used a mixture in which a low-melting point yarn and a flame-retardant yarn are mixed, a composite fiber (e.g., sheath-core type, split type, multiple sea-island type, etc.) composed of a low-melting point portion and a flame-retardant portion, or a blended spun yarn of a low-melting point yarn and a flame retardant yarn. In this case, the fabrics can be utilized as industrial materials, particularly, curtain sheets and blinds. At this time, the ratio between the low-melting point portion and the flame-retardant portion or between the low-melting point yarn and the flame-retardant yarn is preferably from 15:85 to 50:50 (w/w). When the flame retardant portion (or yarn) is present in the amount of less than 50 wt %, the flame retardance of the fabric is deteriorated. Meanwhile, when the flame retardant portion (or yarn) is present in the amount exceeding 85%, the degree of fusion of the flame retardant portion (or yarn) during thermal treatment is low, and as a result, improvement in the stiffness of the fabric is negligible.

In the fabrics according to the present invention, the surface layer, the backing layer, the intermediate layer, the first connecting portion, and the second connecting portion may have different texture densities. For example, the surface layer, the intermediate layer, and the backing layer are configured to have a mesh structure by weaving, and the first and second connecting portions are configured to be denser than the surface layer and the backing layer. When the fabric has a structure in which the inner and outer portions are not exposed, as illustrated in FIG. 1, it does not create a three-dimensional shape. When the fabric has a structure in which the first and second connecting portions are movable in the vertical direction with respect to the surface layer, the intermediate layer, and the backing layer and the inner and outer portions of the layers are exposed due to the mesh structure of the surface layer and the backing layer, it can create a three-dimensional shape. This structure indicates that the fabric can be utilized as a material for light shielding or security. In addition, the fabric can impart new functions to clothes. When the warp threads and the weft threads in the surface layer and the backing layer are positioned at intervals of 0.2 to 2 mm, more desirable effects of the fabric can be attained. Further, it is to be appreciated that the texture structure and design of the surface layer, the backing layer, the intermediate layer, the first connecting portion, and the second connecting portion can be varied.

Furthermore, to minimize of fire damage, flame resistant treatment can be performed in the three-dimensional fabric with three-layered structure.

The invention claimed is:

1. A three-dimensional fabric with three-layered structure, comprising a backing layer, an intermediate layer, a surface layer, a first connecting portion connecting the backing layer and the intermediate layer, and a second connecting portion connecting the intermediate layer and the surface layer wherein warp threads sequentially form the backing layer, the first connecting portion, the intermediate layer, the second connecting portion, and the surface layer, and then connected to the backing layer to form connecting warp threads and again form the backing layer in an alternating and repeating pattern, and wherein the warp threads are sequentially and simultaneously woven from each of the backing layer, the first connecting portion, the intermediate layer, the second connecting portion, and the surface layer, followed by cutting the connecting warp threads.

2. The three-dimensional fabric with three-layered structure according to claim 1, wherein protrusion portions exposed to a surface of fabrics by the warp threads woven without interlacing with weft threads are formed in the surface layer.

3. The three-dimensional fabric with three-layered structure according to claim 1, wherein the first and second connecting portions are woven at the same angle.

4. A three-dimensional fabric with three-layered structure, comprising a backing layer, an intermediate layer, a surface layer, a first connecting portion connecting the backing layer and the intermediate layer, and a second connecting portion connecting the intermediate layer and the surface layer wherein warp threads sequentially form the backing layer, the first connecting portion, the intermediate layer, the second connecting portion, and the surface layer, and then connected to the backing layer to form connecting warp threads and again form the backing layer in an alternating and repeating pattern, and wherein when warp threads started from the backing layer are 1/2/3/4, warp threads from the first connecting portion are 5/6, warp threads started from the intermediate layer are 7/8, warp threads started from the second connecting portion are 9/10, and warp threads started from the surface layer are 11/12/13/14, as indicated by harness numbers, and the warp threads 1/2/3/4 form the backing layer and then the surface layer, and when the warp threads are 1/2/3/4 in contact with the warp threads are 13/14 forming the connecting warp threads toward the backing layer, the warp threads 3/4 form the first connecting portion, and the warp threads 1/2/13/14 form the backing layer, and wherein the warp threads 5/6 form the first connecting portion and woven with the warp threads 7/8 forming the intermediate layer to form stitched intermediate portions, and then the warp threads 5/6 form the intermediate layer and the warp threads 7/8 form the second connecting portion, and wherein the warp threads 11/12/13/14 form the surface layer and woven with the warp threads 9/10 forming the second connecting portion to form stitched surface portions, and then the warp threads 13/14 is connected to the backing layer and the warp threads 9/10/11/12 form the surface layer, followed by cutting the warp threads.

5. The three-dimensional fabric with three-layered structure according to claim 1, wherein the warp threads are woven with a low-melting point yarn.

6. The three-dimensional fabric with three-layered structure according to claim 1, wherein the warp threads are a grey yarn in which a low-melting point yarn and a flame-retardant yarn are mixed or a composite fiber composed of low-melting point portions and flame-retardant portions.

7. The three-dimensional fabric with three-layered structure according to claim 1, wherein the surface layer, the intermediate layer, and the backing layer are formed into a mesh structure by weaving.

8. The three-dimensional fabric with three-layered structure according to claim 1, wherein the first and second connecting portions are denser than the surface layer, the intermediate layer, and the backing layer.

9. A blind using the fabric according to claim 1.

10. The three-dimensional fabric with three-layered structure according to claim 2, wherein the warp threads and/or the weft threads are woven with a low-melting point yarn.

11. The three-dimensional fabric with three-layered structure according to claim 2, wherein the warp threads and/or the weft threads are a grey yarn in which a low-melting point yarn and a flame-retardant yarn are mixed or a composite fiber composed of low-melting point portions and flame-retardant portions.

12. The three-dimensional fabric with three-layered structure according to claim 2, wherein the surface layer, the intermediate layer, and the backing layer are formed into a mesh structure by weaving.

13. The three-dimensional fabric with three-layered structure according to claim 2, wherein the first and second connecting portions are denser than the surface layer, the intermediate layer, and the backing layer.

14. A blind including the fabric according to claim 2.

* * * * *